US009052121B2

(12) United States Patent
Cooper et al.

(10) Patent No.: US 9,052,121 B2
(45) Date of Patent: Jun. 9, 2015

(54) MOBILE WATER HEATING APPARATUS

(71) Applicant: Energy Heating, LLC, Oakley, ID (US)

(72) Inventors: James Alan Cooper, Oakley, ID (US); Gerald Wayne Lind, Oakley, ID (US); Justin Lydell Mason, Oakley, ID (US); Noland Harper Critchfield, Oakley, ID (US); Jeffery K. Cooper, Oakley, ID (US)

(73) Assignee: Intelligent Energy, LLC, Oakley, ID (US)

( * ) Notice: Subject to any disclaimer, the term of this patent is extended or adjusted under 35 U.S.C. 154(b) by 97 days.

(21) Appl. No.: 13/689,654

(22) Filed: Nov. 29, 2012

(65) Prior Publication Data

US 2013/0145996 A1 Jun. 13, 2013

Related U.S. Application Data

(60) Provisional application No. 61/564,988, filed on Nov. 30, 2011, provisional application No. 61/613,449, filed on Mar. 20, 2012, provisional application No. 61/656,951, filed on Jun. 7, 2012, provisional application No. 61/681,587, filed on Aug. 9, 2012.

(51) Int. Cl.
*F24H 1/20* (2006.01)
*F22B 1/18* (2006.01)

(Continued)

(52) U.S. Cl.
CPC ..... *F24H 1/206* (2013.01); *F22B 1/1853* (2013.01); *F24H 1/06* (2013.01); *F22D 5/00* (2013.01);

(Continued)

(58) Field of Classification Search
CPC ..... F22D 1/20; F22D 1/24; F22D 7/04; F22B 1/1853; F22B 21/083; F24H 1/06; F24H 1/206; F24H 1/46; F24H 1/406; F23K 5/22
USPC ..... 122/31.2, 252
See application file for complete search history.

(56) References Cited

U.S. PATENT DOCUMENTS 1,522,120 A 1/1925 Halder
1,527,740 A 2/1925 Lipshitz (Continued)

FOREIGN PATENT DOCUMENTS

CN 1114727 1/1996
EP 0164816 12/1985

(Continued)

OTHER PUBLICATIONS

Heatec.com, Firestorm direct-contact water heaters, http://www.heatec.com/products_concrete/firestorm/firestorm.htm, internet accessed Dec. 7, 2012, 3 pages.

(Continued)

*Primary Examiner* — Steven B McAllister
*Assistant Examiner* — Steven Anderson, II
(74) *Attorney, Agent, or Firm* — Perkins Coie LLP

(57) ABSTRACT

Mobile water heating systems for producing hot water are disclosed herein. In one embodiment, a mobile water heating system includes a water heater having an oval-cylindrical shape. The water heater includes a shell, a lid and a water reservoir having a screen. A first heating coil and a second heating coil can extend between the screen and a first cone and a second cone, respectively. A first burner and a second burner can be configured to mix and combust fuel and air and direct the resulting flames through the heating coils. Pall rings can at least partially fill an interior volume of the water heater and the combustion of the fuel and air can heat the heating coils and the pall rings. Water can be heated by being directed through the heating coils and through a water manifold positioned to spray water on the pall rings.

7 Claims, 14 Drawing Sheets

(51) Int. Cl.

| | |
|---|---|
| ***F24H 1/06*** | (2006.01) |
| ***F22D 5/00*** | (2006.01) |
| ***F24H 1/12*** | (2006.01) |
| ***F24H 1/16*** | (2006.01) |
| ***F24H 9/20*** | (2006.01) |

(52) U.S. Cl.

CPC ..... *F24H 1/125* (2013.01); *F24H 1/165* (2013.01); *F24H 9/2035* (2013.01); *F24D 2220/048* (2013.01)

(56) References Cited

U.S. PATENT DOCUMENTS

| | | | | |
|---|---|---|---|---|
| 1,886,448 | A * | 11/1932 | Smith et al. | 122/169 |
| 2,410,900 | A * | 11/1946 | Radbill | 122/504.1 |
| 2,486,141 | A | 10/1949 | Follo | |
| 2,645,463 | A | 7/1953 | Stearns | |
| 2,892,509 | A * | 6/1959 | Baker et al. | 96/356 |
| 2,969,451 | A | 1/1961 | Logan | |
| 2,987,061 | A | 6/1961 | Huber | |
| 3,232,336 | A | 2/1966 | Leslie et al. | |
| 3,331,366 | A | 7/1967 | Sullivan | |
| 3,581,822 | A | 6/1971 | Cornelius | |
| 3,601,099 | A | 8/1971 | Vaillant et al. | |
| 3,619,380 | A | 11/1971 | Stephens | |
| 3,672,350 | A | 6/1972 | Denis | |
| 3,685,542 | A | 8/1972 | Daughirda | |
| 3,698,430 | A | 10/1972 | Van Gasselt et al. | |
| 3,768,257 | A * | 10/1973 | Neuffer | 60/269 |
| 3,982,910 | A * | 9/1976 | Houseman et al. | 48/61 |
| 4,044,727 | A * | 8/1977 | Rychen et al. | 122/449 |
| 4,574,775 | A | 3/1986 | Lutzen et al. | |
| 4,596,235 | A | 6/1986 | Bougard | |
| 4,658,803 | A * | 4/1987 | Ball et al. | 126/355.1 |
| 4,685,444 | A | 8/1987 | Durrenberger | |
| 4,753,220 | A * | 6/1988 | Lutzen et al. | 126/355.1 |
| 4,782,816 | A | 11/1988 | Salgado et al. | |
| 4,845,981 | A | 7/1989 | Pearson | |
| 4,846,148 | A | 7/1989 | Zifferer | |
| 4,848,468 | A | 7/1989 | Hazlett et al. | |
| 4,966,100 | A * | 10/1990 | Fournier et al. | 122/6 A |
| 5,038,853 | A | 8/1991 | Callaway, Sr. et al. | |
| 5,183,029 | A | 2/1993 | Ranger | |
| 5,197,415 | A | 3/1993 | Stretch et al. | |
| 5,207,211 | A | 5/1993 | Hanning et al. | |
| 5,279,261 | A | 1/1994 | Moscone | |
| 5,479,913 | A | 1/1996 | Adams | |
| 5,520,165 | A * | 5/1996 | Khinkis et al. | 126/355.1 |
| 5,588,088 | A | 12/1996 | Flaman | |
| 5,623,990 | A | 4/1997 | Pirkle | |
| 5,656,136 | A | 8/1997 | Gayaut | |
| 5,699,756 | A | 12/1997 | Ross et al. | |
| 5,765,546 | A | 6/1998 | Mandeville et al. | |
| 5,893,341 | A * | 4/1999 | Cox | 126/350.1 |
| 5,924,391 | A * | 7/1999 | Baker et al. | 126/359.1 |
| 6,024,290 | A | 2/2000 | Dosani et al. | |
| 6,412,561 | B1 | 7/2002 | Brown et al. | |
| 6,776,153 | B1 * | 8/2004 | Walker et al. | 126/355.1 |
| 7,298,968 | B1 | 11/2007 | Boros et al. | |
| 7,477,836 | B2 | 1/2009 | White, III | |
| 7,681,536 | B2 | 3/2010 | Kaupp | |
| 7,694,731 | B2 | 4/2010 | Decker | |
| 7,744,007 | B2 | 6/2010 | Beagen et al. | |
| 7,798,237 | B2 | 9/2010 | Korach et al. | |
| 7,845,411 | B2 | 12/2010 | Vinegar et al. | |
| 8,044,000 | B2 | 10/2011 | Sullivan et al. | |
| 8,171,993 | B2 | 5/2012 | Hefley | |
| 8,176,937 | B2 | 5/2012 | Zhang et al. | |
| 8,220,537 | B2 | 7/2012 | Leon et al. | |
| 8,286,595 | B2 | 10/2012 | Cerney et al. | |
| 2007/0056726 | A1 | 3/2007 | Shurtleff | |
| 2007/0170273 | A1 | 7/2007 | McIllwain | |
| 2008/0029267 | A1 | 2/2008 | Shampine et al. | |
| 2008/0107410 | A1 | 5/2008 | White | |
| 2009/0060659 | A1 | 3/2009 | Wallace | |
| 2009/0308613 | A1 | 12/2009 | Smith | |
| 2010/0000508 | A1 | 1/2010 | Chandler | |
| 2010/0031506 | A1 * | 2/2010 | Hartwig et al. | 29/890.046 |
| 2010/0032031 | A1 | 2/2010 | Neal | |
| 2010/0276149 | A1 | 11/2010 | Pope et al. | |
| 2014/0144393 | A1 | 5/2014 | Chandler | |
| 2014/0144394 | A1 | 5/2014 | Chandler | |
| 2014/0144641 | A1 | 5/2014 | Chandler | |

FOREIGN PATENT DOCUMENTS

| | | |
|---|---|---|
| EP | 0255919 | 2/1988 |
| EP | 0341185 | 11/1989 |

OTHER PUBLICATIONS

Kemcosystems.com, TE 100 Direct Contact Water Heater, http://www.kemcosystems.com/Water-System-Components/TE100-Water_heater.html, internet accessed Dec. 7, 2012, 1 page.

PSNC Energy, "Commercial and Industrial Facilities Go 'Tankless,'" Retrieved from: http://web.archive.org/web/20061118194825/http://www.psncenergy.com/en/small-to-medium- business/business-sectors/hospitality/commercial-industrial-facilities-go-tankless.htm; last accessed on Aug. 13, 2014.

Habib D. Zughbi et al., "Mixing in Pipelines with Side and Opposed Tees," Ind. Eng. Chem. Res., American Chemical Society, 42 (21), pp. 5333-5344 (2003).

Keng Seng Chan et al., "Oilfield Chemistry at Thermal Extremes," Oilfield Review, pp. 4-17 (Autumn 2006).

Heatec, Inc., Webpage describing Firestorm Direct-Contact Water Heaters, Retrieved from: http://web.archive.org/web/20080511165612/http://www.heatec.com/products_concrete/firestorm/firestorm.htm; last accessed on Aug. 13, 2014.

CAT, "Hydration Unit mixing unit for preparation fracturing fluids," Retrieved from: http://www.consulting-agencytrade.com/files/hydration unit 04.pdf; last accessed on Oct. 8, 2014.

Armstrong, "Flo-Rite-Temp Steam heats water instantly-in a fraction of space," Retrieved from: https://web.archive.org/web/20071213171904/http://www.armstronginternational.com/files/products/wheaters/pdf/ay408.pdf: last accessed on Oct. 3, 2014.

KOMAX Steam Heaters, "Inline Steam Heater," Retrieved from: https://web.archive.org/web/20080420074231/http://www.komax.com/products/inline steam heater.html: last accessed on Oct. 7, 2014.

English Translation of Chinese Patent Publication No. CN1114727; Machine translation retrieved from Espacenet Patent Search, http://worldwide.espacenet.com/?locate=en_EP on Aug. 13, 2014.

* cited by examiner

MOBILE WATER HEATING APPARATUS

CROSS-REFERENCE TO RELATED APPLICATIONS

The present application claims priority to the following U.S. Provisional Applications: Application No. 61/681,587, filed on Aug. 9, 2012, and entitled "MOBILE WATER HEATING APPARATUS;" Application No. 61/656,951, filed on Jun. 7, 2012, and entitled "MOBILE WATER HEATING APPARATUS:" Application No. 61/613,449, filed on Mar. 20, 2012, and entitled "MOBILE WATER HEATING APPARATUS:" and Application No. 61/564,988, filed on Nov. 30, 2011, and entitled "WATER HEATING APPARATUS," each of which is incorporated herein by reference its entirety.

TECHNICAL FIELD

The following disclosure relates generally to water heaters, and more particularly to mobile water heaters having multiple burners and multiple flame tubes or heating coils.

DETAILED DESCRIPTION

Figure 1:
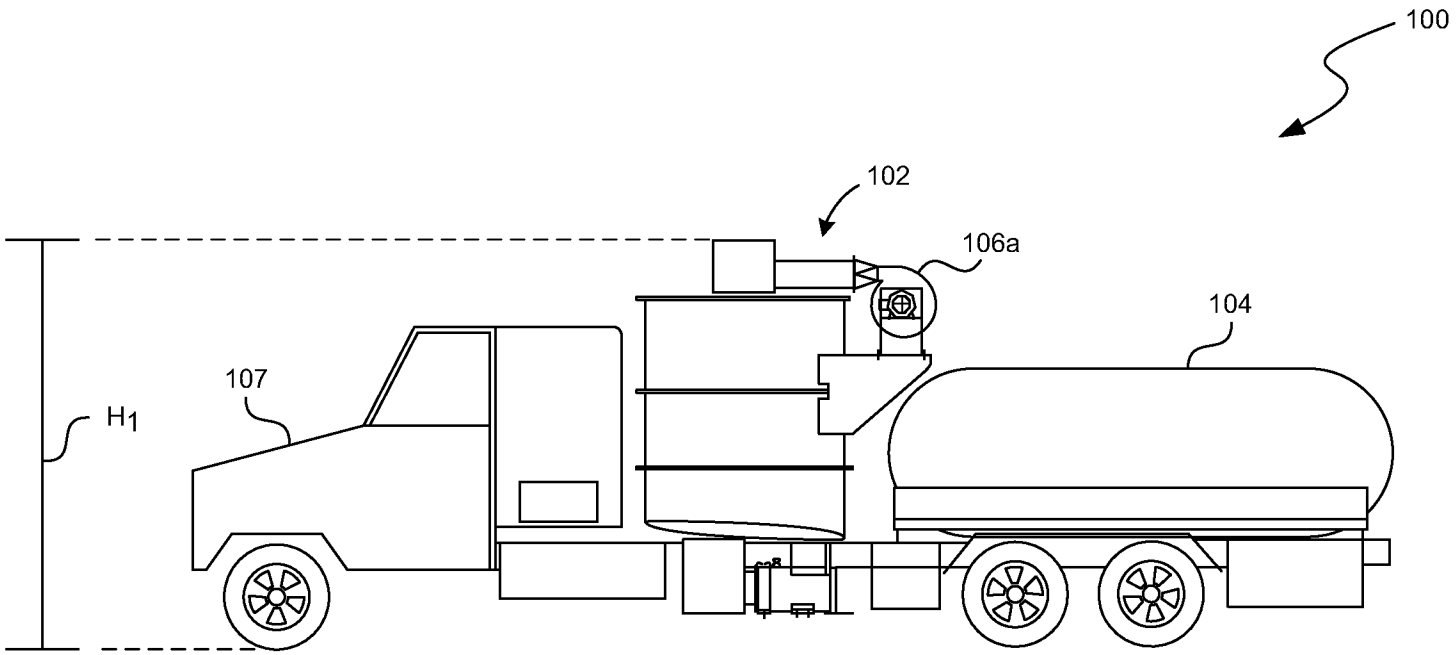
FIG. 1 is a side elevation view of a mobile water heating system having a water heater configured in accordance with an embodiment of the present disclosure.

Direct contact water heaters can be used in industrial applications to heat large volumes of water for various applications. These water heaters can come in various configurations and sizes that produce varying volumes of hot water. Generally, the larger the size of the water heater, the larger the volume of hot water that can be produced. In many applications, water heaters are permanently installed in a particular location, and the size of the water heater may not be critical. However, several industrial applications require hot water in a variety of locations that may change over a period of time. For example, drilling and/or mining operations are often conducted over a large area or at different sites over a period of time. These applications can require very large volumes of hot water, but cannot utilize a permanently installed and immobile large water heater. Adapting existing high volume direct contact water heaters to a mobile platform is not practical because the size of the mobile platform would prevent its use on most roadways.

The following disclosure describes several embodiments of mobile direct contact water heaters having multiple burners and multiple flame tubes. Several of the embodiments described below include features or advantages that overcome the limitations of existing water heaters. However, reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize that the invention can be practiced without one or more of the specific features or advantages of a particular embodiment. In other instances, additional features and advantages may be recognized in certain embodiments that may not be present in all embodiments of the invention. Additionally, in the following description of various embodiments of the present invention, numerous specific details are set forth in order to provide a thorough understanding of embodiments of the present invention. In other instances, well known components, methods and procedures have not been described so as not to unnecessarily obscure aspects of the embodiments of the present invention.

The features and advantages of the present invention will become more fully apparent from the following description, or may be learned by the practice of the invention as set forth hereinafter. In order that the advantages of the invention will be readily understood, a description of the invention will be rendered by reference to specific embodiments that are illustrated in the appended drawings. Understanding that these drawings depict only typical embodiments of the invention and are not therefore to be considered to be limiting of its scope, the invention will be described and explained with reference to the accompanying drawings.

FIG. 1 is a side elevation view of a mobile water heating system 100 having a water heater 102 configured in accordance with an embodiment of the present disclosure. In the illustrated embodiment, the water heater 102 and a fuel tank 104 are operably attached to a ground vehicle, e.g., a truck 107. The water heater 102 can include a first blower 106*a* and a second blower 106*b* (not visible), identified collectively as the blowers 106. Although the illustrated embodiment includes two blowers 106, other embodiments can include more or fewer blowers 106. The fuel tank 104 can be configured to hold a variety of suitable fuels (e.g., propane, natural gas, diesel fuel, etc.), and the water heater 102 can be configured to burn a variety of suitable fuels. In the illustrated embodiment, the water heater 102 is configured to burn liquid propane gas (LPG) and the fuel tank 104 is configured to receive, store and deliver LPG. However, in other embodiments, other fuels can be burned by the water heater 102 and stored in the fuel tank 104. Accordingly, it should be understood that reference to LPG throughout the present disclosure is illustrative of an embodiment of the disclosure, and that other embodiments can utilize a variety of other suitable fuels.

As discussed above, larger direct contact water heaters generally produce larger volumes of hot water. Accordingly, for several high volume applications requiring mobile hot water production, large mobile hot water heaters would be beneficial. However, in the United States, the maximum height allowed on roadways is regulated at the State level. The maximum vehicle height to ensure travel within all states is 4.1 meters (13.5 feet). The maximum overall vehicle width permitted to travel on the National Network of highways is regulated at the Federal level and is limited to 2.6 meters (102 inches). Accordingly, the dimensions of the heating system 100 and the water heater 102 must be within these limits to ensure travel on the National Network of highways. In the illustrated embodiment of FIG. 1, the heating system 100 has an overall width less than 2.6 meters and an overall height $H_1$ equal to 4.0 meters, and can thereby operate on roadways of all 50 states. Several features of the water heater 102 provide for the production of large volumes of hot water within these size restrictions, as described in detail below.

Figure 2:
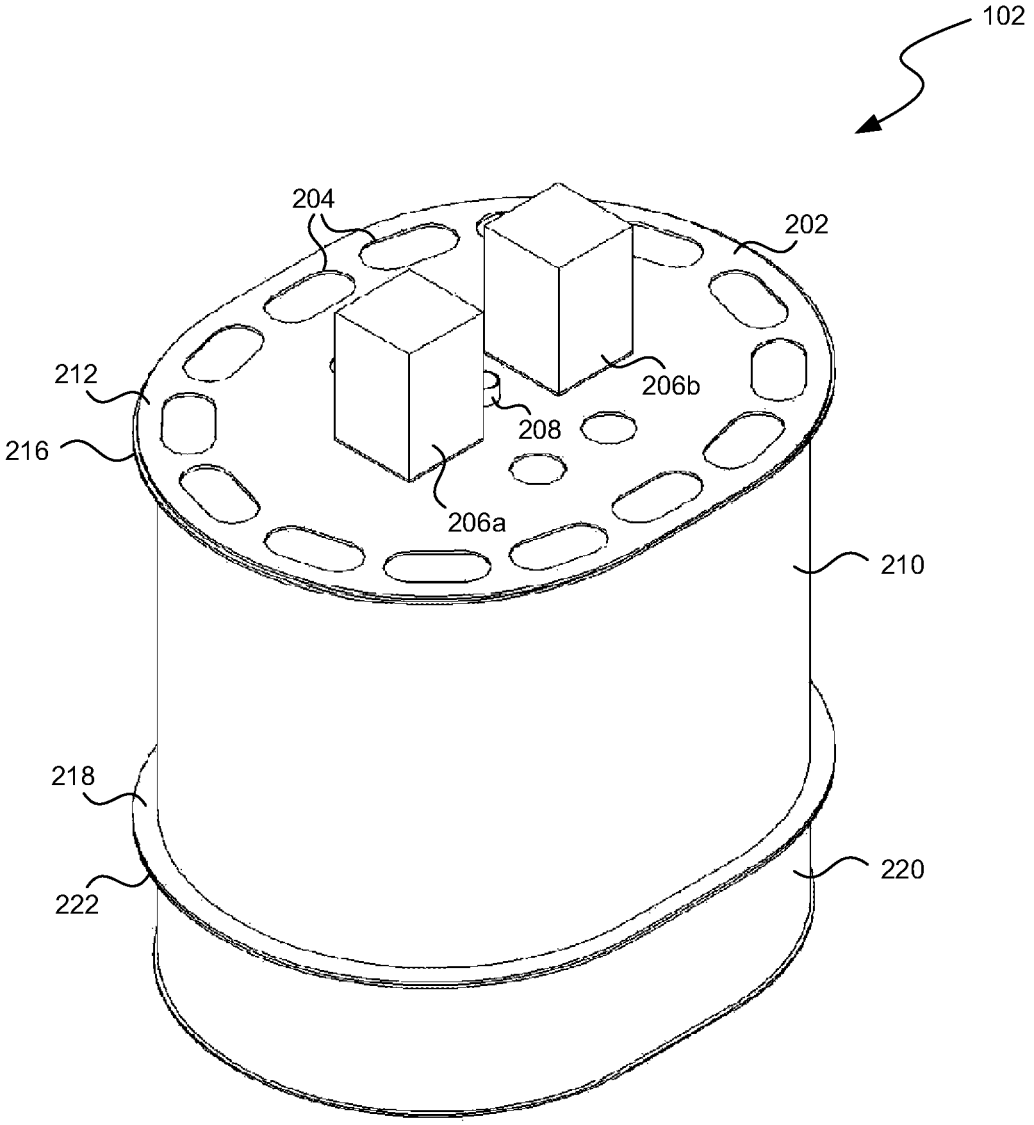
FIG. 2 is a partially schematic isometric view of the water heater of FIG. 1.

FIG. 2 is a partially schematic isometric view of the water heater 102 configured in accordance with an embodiment of the present disclosure. The water heater 102 in the illustrated embodiment is shaped as an oval cylinder and includes a lid 202 having a plurality of exhaust vents 204. A pair of burner stacks 206 (identified individually as a first burner stack 206*a* and a second burner stack 206*b*) are operably coupled to a topside of the lid 202. The lid 202 is removably coupled to a shell 210 and a water inlet 208 extends through the lid 202. The perimeter of the lid 202 includes a flange 212 having a plurality of bolt holes (not shown). The shell 210 includes an upper flange 216 and a lower flange 218. The upper flange 216 includes a plurality of bolt holes (not shown) that align with the bolt holes of the flange 212 on the lid 202. The lid 202 can be removably coupled to the shell 210 by inserting bolts through the aligned bolt holes. The shell 210 is removably coupled to a water reservoir 220 having a flange 222 via a plurality of aligned bolt holes (not shown) in the flange 222 and the lower flange 218.

Figure 3:
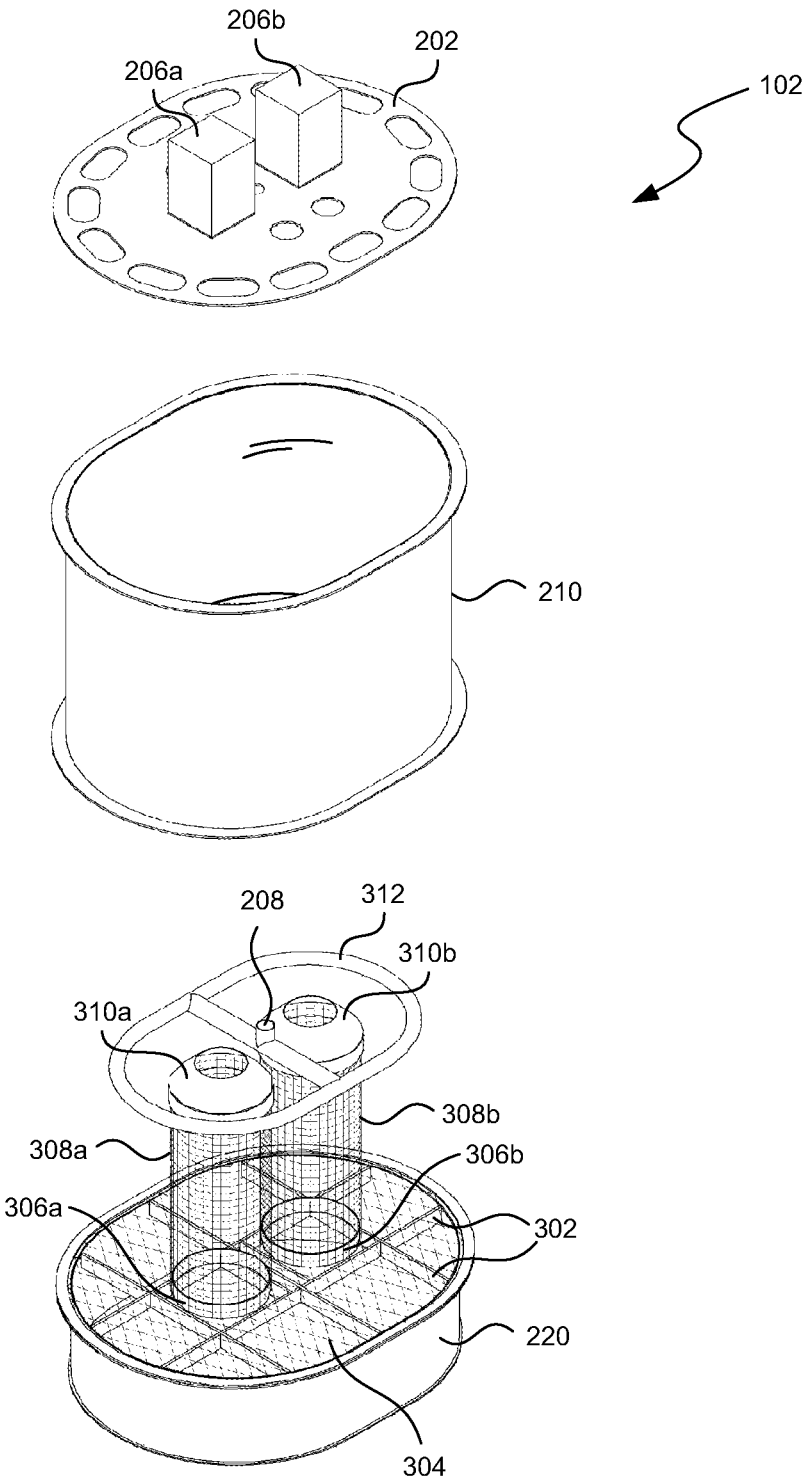
FIG. 3 is a partially schematic, exploded, isometric view of the water heater of FIG. 2 configured in accordance with an embodiment of the present disclosure.

FIG. 3 is a partially schematic, exploded, isometric view of the water heater 102. In the illustrated embodiment, the water reservoir 220 includes a plurality of slats 302 supporting a screen 304. A pair of metal rings 306 (identified individually as a first metal ring 306*a* and a second metal ring 306*b*) are fixedly attached to the slats 302 and/or the screen 304. A first flame tube 308*a* and a second flame tube 308*b* (collectively the flame tubes 308) enclose the metal rings 306*a* and 306*b* and extend from the screen 304 to a first cone 310*a* and a second cone 310*b* (identified collectively as the cones 310), respectively. The cones 310 encircle an upper portion of the flame tubes 308 and can at least partially secure the flame tubes 308 in an upright position. The flame tubes 308 can be constructed in a variety of suitable manners and from a variety of suitable materials. For example, the flame tubes 308 of FIG. 3 include rolled metal mesh. In other embodiments the flame tubes 308 can include rolled metal and/or other suitable materials. The cones 310*a* and 310*b* can enclose a portion of the flame tubes 308*a* and 308*b* and can be fixedly attached to an underside of the lid 202 opposite the first burner stack 206*a* and the second burner stack 206*b*, respectively. A water manifold 312 includes the water inlet 208 and a plurality of water nozzles (not shown in FIG. 3). The water manifold 312 can be operably coupled to the underside of the lid 202 and the inlet 208 can extend through the lid 202 (as shown in FIG. 2).

In the illustrated embodiment, the oval-cylindrical shape of the water heater 102 provides space within the shell 210 for the two flame tubes 308 to be positioned side by side. In other embodiments, the water heater 102 can be constructed in a variety of shapes and can have additional burner stacks 206 and flame tubes 308. For example, the water heater 102 can be cylindrical, an elliptic cylinder, or can be a rectangular cuboid and can contain three or more burner stacks 206 and corresponding flame tubes 308. The shape of the water heater 102 and the number of flame tubes 308 and burner stacks 206 can be selected to increase the thermal efficiency and capacity of the water heater 102.

Figure 4A:
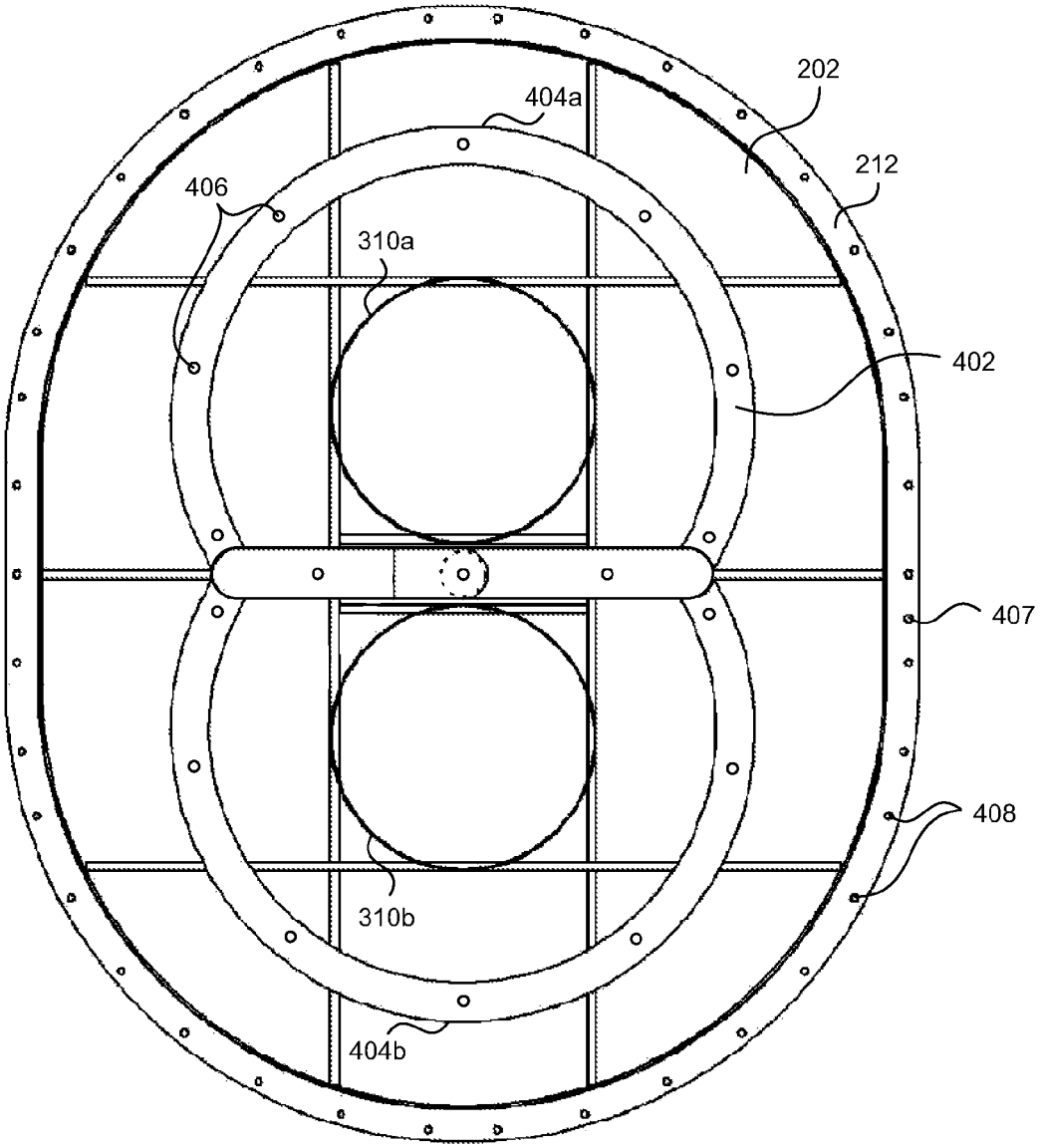
FIG. 4A is a bottom view of a lid having a manifold configured in accordance with an embodiment of the present disclosure.

FIG. 4A is a bottom view of the lid 202 having a manifold 402 configured in accordance with an embodiment of the present disclosure. The manifold 402 of the illustrated embodiment is similar in structure and function to the manifold 312 discussed above with reference to FIG. 3 and can be used in place of the manifold 312. The manifold 402 is shaped similar to a figure-eight with two loops 404*a* and 404*b* encircling the cones 310*a* and 310*b*, respectively. A plurality of water outlets (e.g., holes) or nozzles 406 are installed in or on the water manifold 402 and positioned to encircle the cones 310. The lid 202 includes bolt holes 408 positioned along the flange 212. The lid 202 can include an asymmetrically positioned bolt hole 407 that corresponds to an asymmetrically positioned bolt hole on the upper flange 216 of the shell 210. The asymmetrically positioned bolt hole 407 can ensure the lid 202 can only be removably coupled to the shell 210 in a particular orientation. The selected orientation can ensure components that are attached to the shell 210 or the lid 202 are correctly aligned for interconnections with components attached to the truck 107 or other parts of the mobile water heating system 100.

Figure 4B:
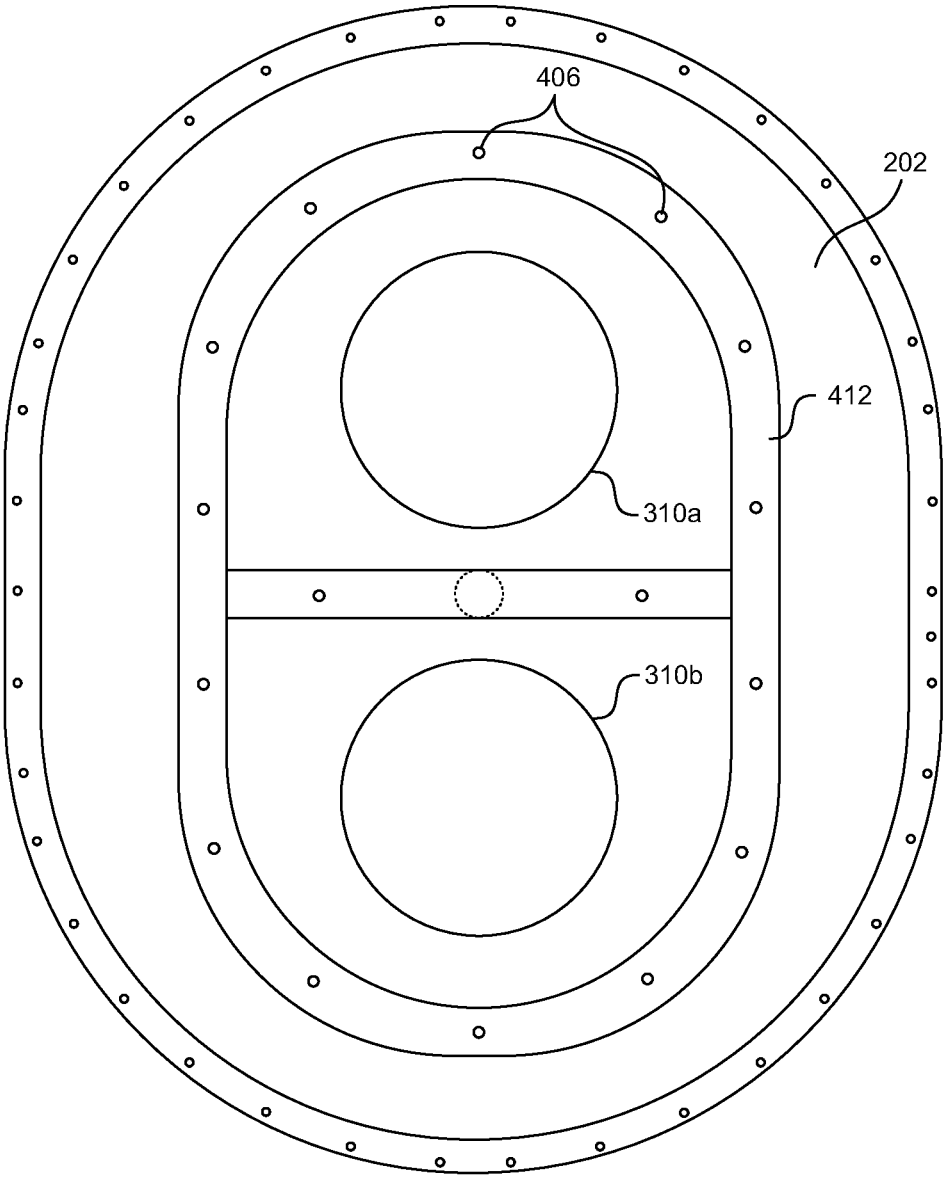
FIGS. 4B and 4C are bottom views of lids having manifolds configured in accordance with embodiments of the present disclosure.
Figure 4C:
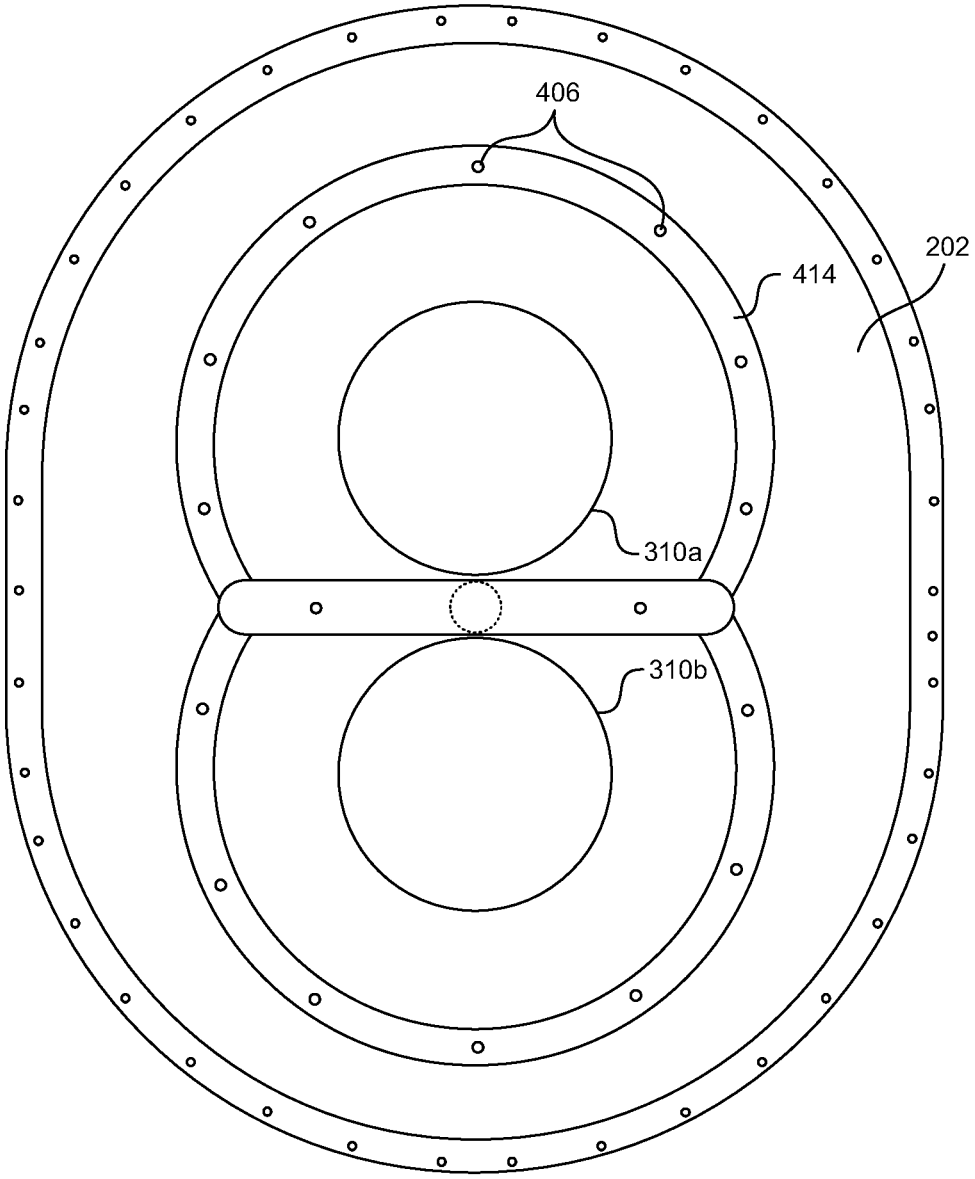

FIGS. 4B and 4C are bottom views of lids 202 having manifolds 412 and 414, respectively, configured in accordance with additional embodiments of the present disclosure. In the illustrated embodiments, the manifolds 412, 414 include nozzles 406 positioned around the cones 310*a*, 310*b* in a manner at least generally similar to the manifolds 312 and 402. The nozzles 406 can be positioned in a variety of suitable locations and arrangements. In the illustrated embodiments, for example, each individual nozzle 406 is spaced at least approximately equidistant from the nearest two nozzles 406.

Figure 5:
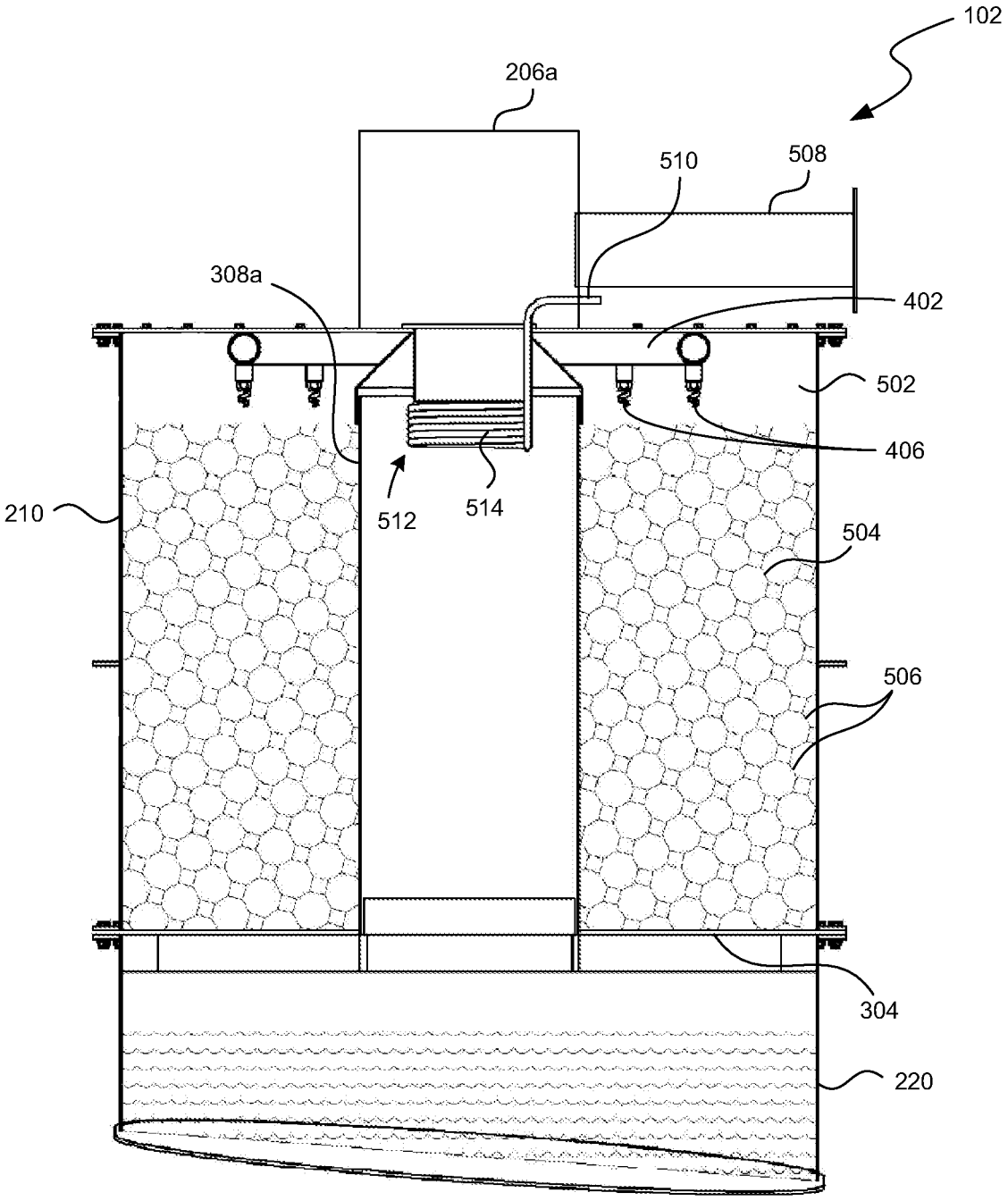
FIG. 5 is a partially schematic, partial cross-sectional side view of the water heater of FIG. 3 configured in accordance with an embodiment of the present disclosure.

FIG. 5 is a partially schematic, partial cross-sectional side view of the water heater 102 configured in accordance with an embodiment of the present disclosure. The shell 210 encloses an internal volume 502 that includes the flame tubes 308. The internal volume 502 can be at least partially filled with a heat transferring media 504. In the illustrated embodiment, the media 504 includes a plurality of pall rings 506. In other embodiments, the heat transferring media 504 can include a variety of other suitable material or devices (e.g., nutter rings, kings, P-rings, etc.) that encircle the flame tubes 308 and at least partially fill the internal volume 502. The screen 304 can have openings sized to prevent the media 504 from falling into the water reservoir 220. The burner stacks 206 can include an air inlet duct 508, a fuel (e.g., propane) inlet 510 and a burner 512 having a fuel vaporization coil 514 and a fuel (e.g., propane) outlet (not shown in FIG. 5). The fuel inlet 510 can be operably coupled to the fuel tank 104 (FIG. 1) and the inlet duct 508 can be operably coupled to the blower 106 (FIG. 1) to provide fuel and air, respectively, to the blower stacks 206.

Figure 7:
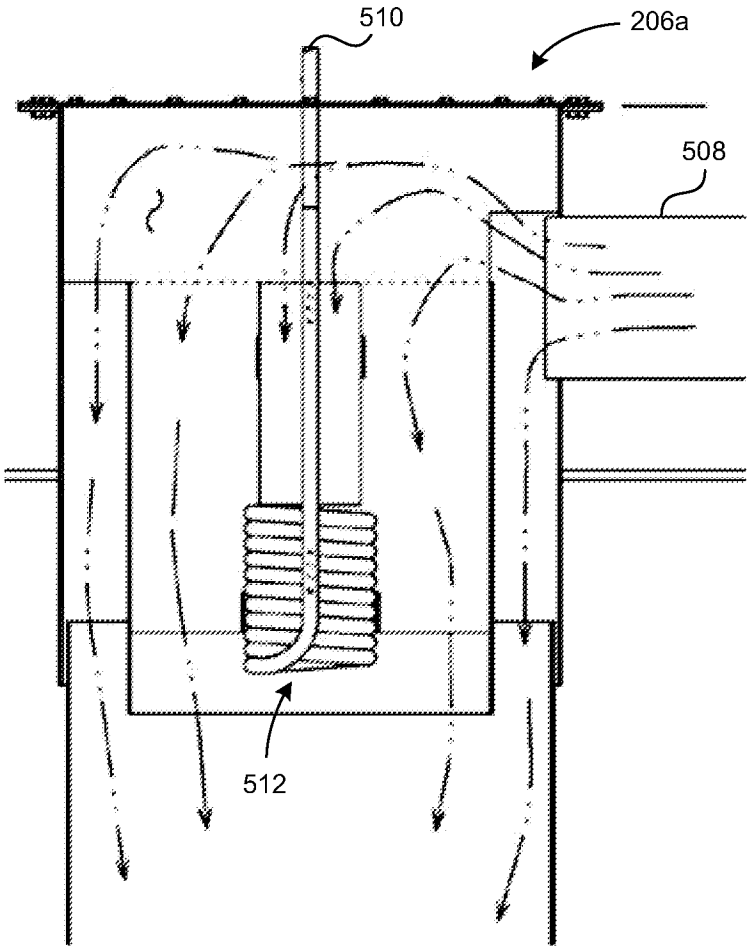
FIGS. 6 and 7 are partially schematic, partial cross-sectional side views of burner stacks configured in accordance with another embodiment of the present disclosure.
Figure 6:
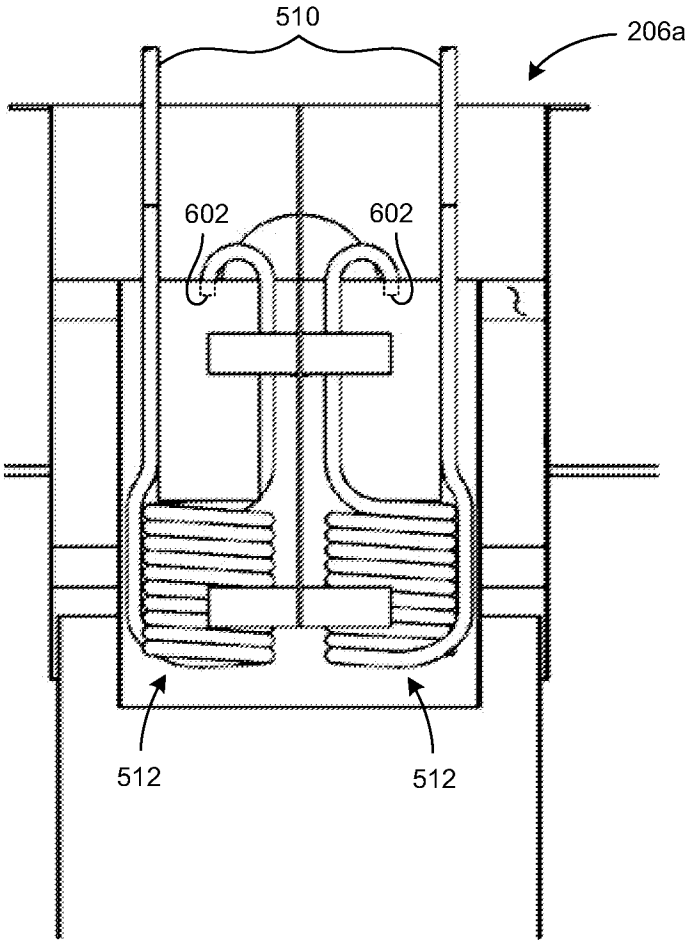

FIGS. 6 and 7 are partially schematic, partial cross-sectional side views of one of the burner stacks 206 configured in accordance with another embodiment of the present disclosure. In the illustrated embodiment, the burner stack 206*a* includes two burners 512 (only one burner 512 is visible in FIG. 7). In other embodiments, the burner stack 206*a* can include more or fewer burners (e.g., one burner 512, as shown in FIG. 5, or three or more burners 512). The burners 512 include fuel (e.g., propane) outlets 602, directed toward an interior portion of the burners 512. Air from the inlet duct 508 can enter the burner stack 206*a* and pass through and around the burners 512, as shown by the arrows in FIG. 7.

Figure 8:
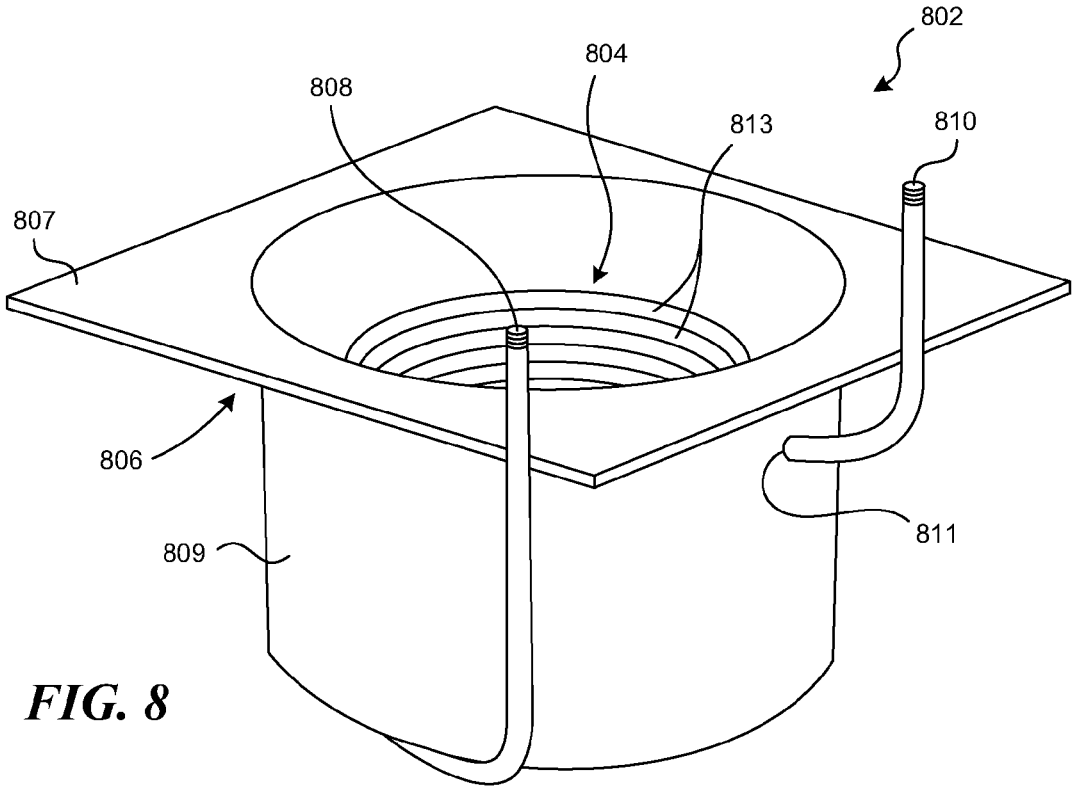
FIG. 8 is an isometric view of a vaporizer assembly configured in accordance with another embodiment of the present disclosure.

FIG. 8 is an isometric view of a vaporizer assembly 802 configured in accordance with an embodiment of the present disclosure. In the illustrated embodiment, the vaporizer assembly 802 includes a length of conduit or tubing identified as a vaporization coil 804 and a housing 806. The vaporization coil 804 is positioned partially within the housing 806 and includes a fuel (e.g., propane) inlet 808 and a fuel (e.g., propane) outlet 810. The housing 806 includes a generally flat support plate 807 fixedly attached to an upper portion of an annular base 809. The vaporization coil 804 can be made from a metal or metal alloy tube that can be bent or shaped into the shape shown in FIG. 8.

In the illustrated embodiment, the vaporization coil 804 extends from the fuel inlet 808, under the base 809, and through a series of coils 813 forming a cylinder within the base 809. The coils 813 can extend around an internal surface of the annular base 809, with each successive coil positioned on top of the preceding coil. From the coils 813, the vaporization coil 804 extends through a hole 811 in a sidewall portion of the base 809 to the fuel outlet 810. In one embodiment, the vaporizer assembly 802 can be positioned within a flame tube in a manner at least generally similar to the vaporization coil 514 described above with respect to FIG. 5. Although the illustrated embodiment of FIG. 8 includes the housing 806 having an annular base 809 and the vaporization coil 804 having the series of coils 813, in other embodiments, the vaporizer assembly 802 can be configured in a variety of other suitable arrangements. For example, in one embodiment, the vaporizer assembly 802 can be constructed without the housing 806. Additionally, the housing 806 and/or the vaporization coil 804 can be shaped in a variety of suitable manners. For example, the coils 813 and the base 806 can be ovoid, rectangular or square.

Figure 9:
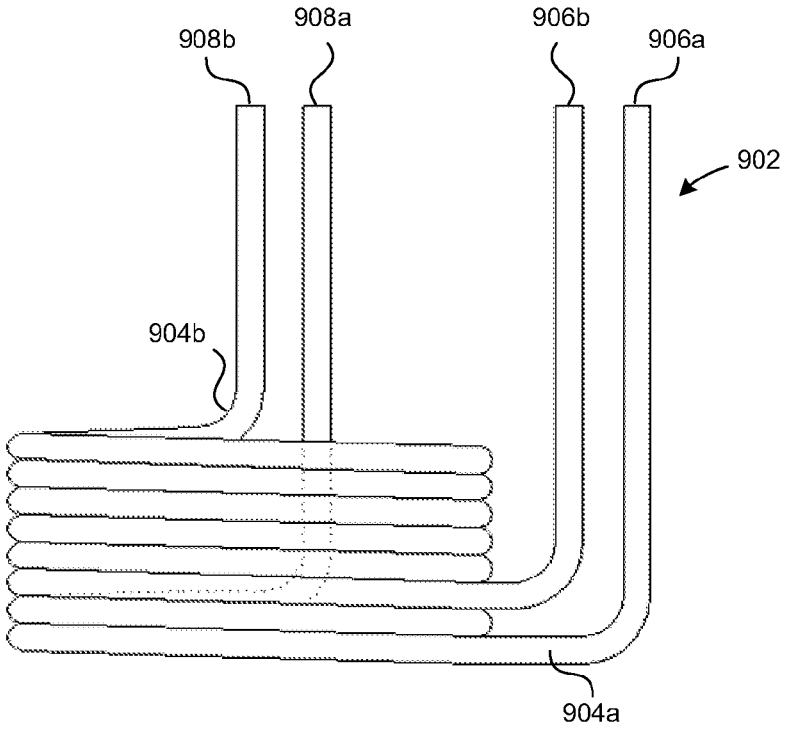
FIG. 9 is a side view of a dual-coil vaporization coil configured in accordance with another embodiment of the present disclosure.

In some embodiments, a plurality of individual vaporization coils can be connected to form a larger vaporization coil. FIG. 9, for example, is a side view of a dual-coil vaporization coil 902 having a first vaporization coil 904*a* and a second vaporization coil 904*b* (identified collectively as the vaporization coils 904). The vaporization coils 904 can include fuel (e.g., propane) inlets 906 (identified individually as a first fuel inlet 906*a* and a second fuel inlet 906*b*) and fuel (e.g., propane) outlets 908 (identified individually as a first fuel outlet 908*a* and a second fuel outlet 908*b*). In one embodiment, the vaporization coils 904 can be connected together in series. For example, the fuel outlet 908*a* of the first vaporization coil 904*a* can be connected to the fuel inlet 906*b* of the second vaporization coil 904*b* to superheat the already vaporized fuel.

Figure 10:
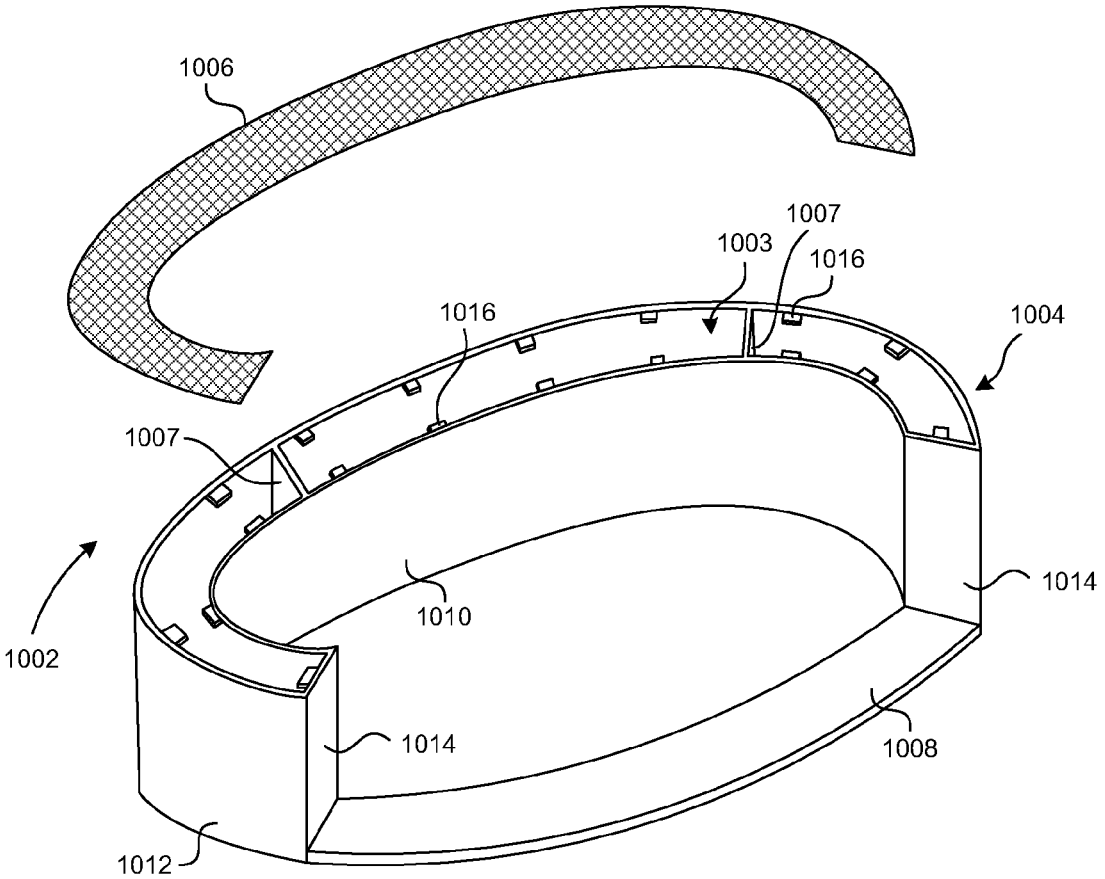
FIG. 10 is a partially schematic, exploded isometric view of a lid, a vent assembly, and a plurality of diffusers configured in accordance with an embodiment of the present disclosure.
Figure 10:
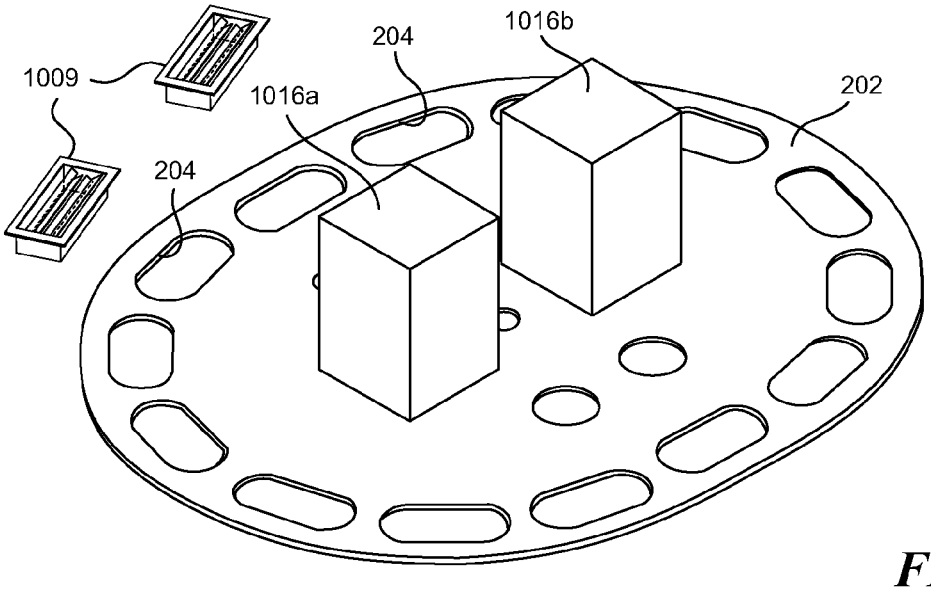

FIG. 10 is a partially schematic, exploded isometric view of a vent assembly 1002 and a plurality of vent covers or diffusers 1009 that can be installed on the lid 202 in accordance with an embodiment of the present disclosure. The individual diffusers 1009 can be positioned in individual exhaust vents 204 to reduce moisture loss and increase efficiency of the water heater 102, as further described below. In the illustrated embodiment, the vent assembly 1002 includes a cover screen 1006, a "C" shaped enclosure 1004 having an interior 1003, and a curved cover plate 1008. The enclosure 1004 includes an inner wall 1010, an outer wall 1012, end walls 1014 and a plurality of mounting brackets 1016 positioned along upper edge portions thereof. Dividers 1007 can be positioned between the inner wall 1010 and the outer wall 1012. The dividers 1007 can divide the vent assembly 1002 into several separate portions or sections and can provide structural support to the vent assembly 1002. The enclosure 1004 can be fixedly attached to the curved cover plate 1008 by welding or another suitable method, and the cover screen 1006 can be removably attached to the mounting brackets 1016 via fasteners through the brackets 1016. The vent assembly 1002 can be removably attached to the lid 202 with the curved cover plate 1008 covering several individual exhaust vents 204, and the remaining exhaust vents 204 being open to the interior 1003 of the enclosure 1004 through individual diffusers 1009. The interior 1003 can be filled with a media (not shown), e.g., pall rings, to trap free moisture from the exhaust that is not removed by the diffusers 1009.

Although the illustrated embodiment of FIG. 10 includes a vent assembly 1002 having an enclosure 1004 that is divided into multiple sections by the dividers 1007, in other embodiments, the enclosure 1004 can be constructed without dividers and include an undivided interior 1003. Furthermore, in some embodiments, the vent assembly 1002 can include several independent enclosures that can each be individually attached to the lid 202. For example, in some embodiments two or more individual enclosures can be attached to the lid 202 at different locations to collect and trap free moisture from the exhaust.

The illustrated embodiment of FIG. 10 includes a pair of high-efficiency burners 1016 (identified individually as a first burner 1016*a* and a second burner 1016*b*), shown schematically. The burners 1016 can be operably coupled to the lid 202 and/or the vaporizer assembly 802 of FIG. 8. In one embodiment, the burners 1016 can be Ovenpak Industrial Burners, produced by Maxon Corp. High-efficiency burners, such as Ovenpak Industrial Burners can be designed to operate at an optimum efficiency on low pressure gas. In some embodiments, the burners 1016 can include a self contained blower that operates in conjunction with, or independent of, the blowers 106. The burners 1016 can be operably coupled to the fuel outlet 810 of the vaporizer assembly 802 of FIG. 8 and/or to the fuel outlets 908 of the vaporization coil 902 of FIG. 9. In operation, the vaporizer assembly 802 and/or the vaporization coil 902 can convert the LPG from the fuel tank 104 (FIG. 1) to gaseous propane, which is delivered to the burners 1016 for efficient burning, as will be further described below.

Figure 11:
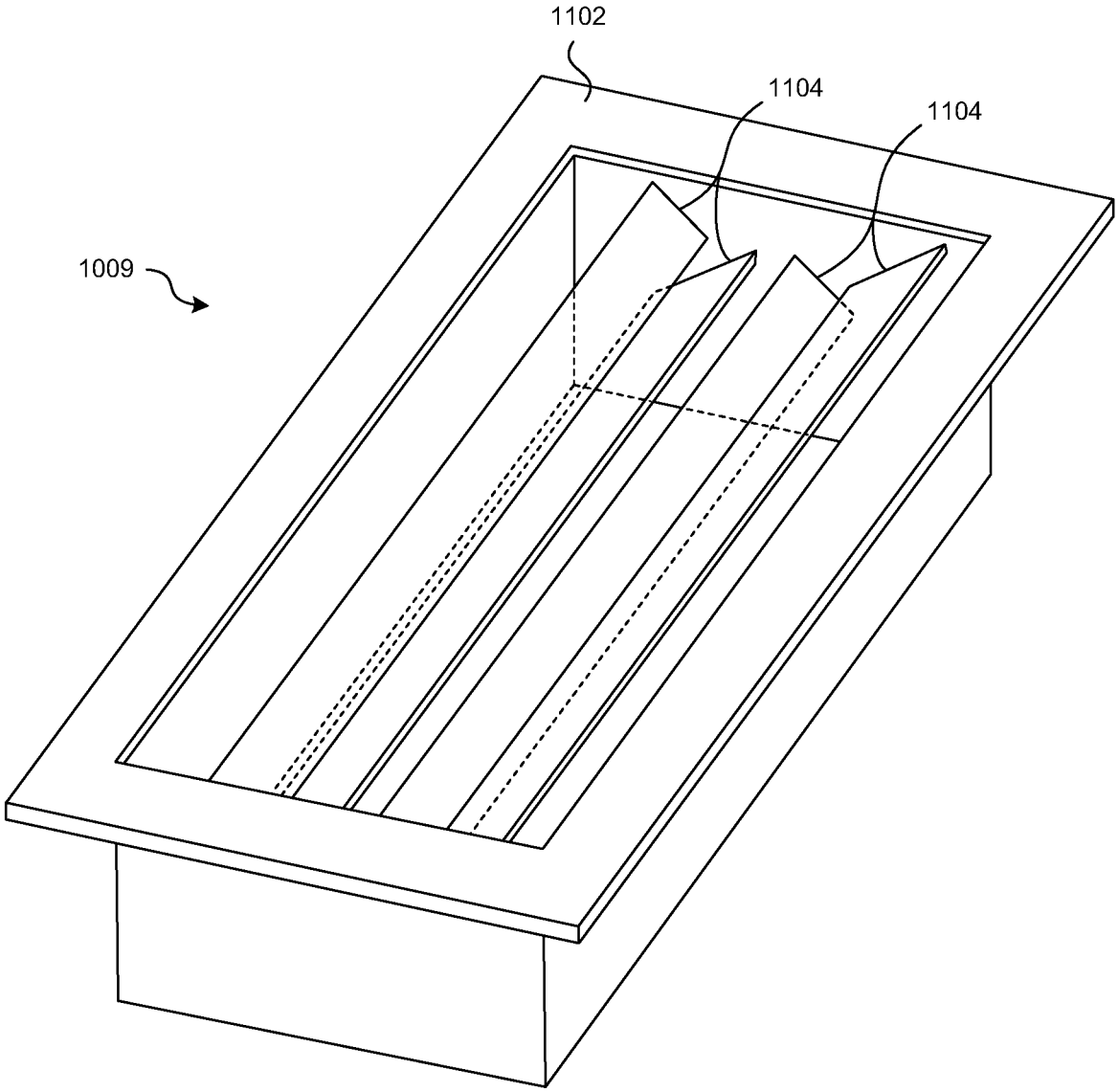
FIG. 11 is an isometric view of a diffuser configured in accordance with an embodiment of the present disclosure.

FIG. 11 is an isometric view of an individual diffuser 1009 configured in accordance with an embodiment of the present disclosure. In the illustrated embodiment, the diffuser 1009 includes a frame 1102 and a plurality of slats 1104. The slats 1104 can be fixedly attached to the frame 1102 with the slats 1104 positioned at an angle to horizontal. Additionally, the slats 1104 can be positioned in an offset pattern, as shown in FIG. 11. The angled slats 1104 and the offset pattern can create a labyrinth path for air that exits through the diffuser 1009. The labyrinth path can aid in removing free moisture from an exhaust flow, and thereby increase the efficiency of the water heater by reducing the emission of heated water vapor.

FIGS. 1-11 illustrate several components and features of the mobile water heating system 100. However, several additional components or features have not been illustrated so as not to obscure the illustrated embodiments. For example, the heating system 100 can include an electric generator to provide power for various components. Additionally, pumps, pipes, hoses, valves and various other suitable components can be included in the mobile water heating system 100 to facilitate its operation. A filtration system can be included to remove impurities or other material from water prior to introducing the water into the water heater 102. A control panel, control circuits, switches, level sensors, and various other suitable electric or electromechanical devices can be included in the mobile water heating system 100 to control the operation of various components or automate operations of the water heater 102 or other components.

In operation, the water heater 102 can burn LPG from the fuel tank 104 to heat water from a water source (not shown). Referring to FIGS. 1-11 together, a hose or series of hoses can be connected to the water heating system 100 and a pump can pump water from the water source to the water inlet 208. LPG from the fuel tank 104 can be directed to the fuel inlets 510 of the burners 512 and the blowers 106 can blow air into the burner stacks 206 through the inlet duct 508. The LPG and the air can mix within the burners 512 to form a combustible mixture. An ignitor (not shown) can ignite the combustible mixture, creating flames that extend through the cones 310 and into the flame tubes 308. The flames and combustion gases heat the vaporization coils 514 causing the LPG to vaporize (e.g., transforming the LPG from a liquid fuel to a gaseous fuel) and providing a more efficient burning process.

In embodiments having high efficiency burners, such as the burners 1016 of FIG. 10, the LPG can be directed from the fuel tank 104 to one or more of the vaporizer assemblies 802 (FIG. 8) or vaporizer coils 902 (FIG. 9) via the fuel inlets 808 or 906. Similar to the operation described above, all or a portion of the LPG can be vaporized in vaporization coils 804 or 904 and delivered to the burners 1016 for efficient burning. The burners 512 or 1016 and air from the blowers 106 or the self contained blowers direct the flames and combustion gases downwardly through the flame tubes 308 heating the flame tubes 308 and the pall rings 506 surrounding the flame tubes 308. The cones 310 reduce the area of the lid 202 directly exposed to heat from within the flame tubes 308. This reduced exposure of the lid 202 to direct heating can reduce undesirable overheating of the lid 202.

In embodiments having flame tubes 308 constructed from rolled metal or other solid material, the combustion gases exit the lower end of the flame tubes 308 and pass into the water reservoir 220. The combustion gases then rise through the shell 210, further heating the pall rings 506 and the flame tubes 308, and then exit through the exhaust vents 204. In embodiments having wire mesh flame tubes 308, the combustion gases can also pass through the wire mesh along the length of the flame tubes 308 and proceed through the pall rings 506. As discussed above, the diffusers 1009 can be positioned in the exhaust vents 204. The diffusers 1009 can reduce the amount of free moisture that is carried by the exhaust out of the shell 210, thereby increasing the efficiency of the mobile water heating system 100. Additionally, the vent assembly 1002 can further reduce the amount of free moisture carried by the exhaust. In embodiments having the vent assembly 1002, the exhaust exits the shell 210 through the diffusers 1009 and enters the interior 1003 of the enclosure 1004. The exhaust passes through the media (e.g., pall rings) within the enclosure 1004 and exits through the cover screen 1006. As the exhaust passes through the enclosure 1004, moisture in the exhaust condenses on the media and returns to the shell 210 through the exhaust vents 204 and/or the diffusers 1009. The removal of this additional moisture from the exhaust further increases the efficiency of the mobile water heating system 100.

The pumped water enters the manifold 312, 402, 412 or 414 through the inlet 208 and is sprayed out of the nozzles 406. The water is sprayed onto the heated pall rings 506 and/or the flame tubes 308 and heat from the pall rings 506 and/or the flame tubes 308 is transferred to the water. In some embodiments, the water can be sprayed onto the pall rings 506 without being sprayed directly onto the flame tubes 308. For example, in some embodiments the nozzles 406 can be positioned and/or shaped to direct a spray pattern of water onto the pall rings 506 without spraying water directly onto the flame tubes 308. In other embodiments, the nozzles 406 can be positioned and/or shaped to spray water directly onto the pall rings 506 and directly onto the flame tubes 308. In yet other embodiments, the nozzles 406 can be positioned and/or shaped to spray water directly onto the flame tubes 308 without spraying water directly onto the pall rings 506. The heated water travels downwardly through the shell 210 under the force of gravity and can undergo further heating through additional contact with the heated pall rings 506 and/or the flame tubes 308. Additionally, the combustion gases and/or the flames can provide direct heating of the water as the water travels through the shell 210. Without wishing to be bound by theory, it is believed that in some embodiments the pall rings 506 can act to slow and disperse the water as it passes through the shell 210, thereby providing increased heating of the water by the combustion gases and/or the flames. The heated water passes through the shell 210 and falls through openings in the screen 304 into the water reservoir 220. The flame and combustion gases from the flame tubes 308 are directed downwardly into contact with the heated water in the reservoir 220, providing additional heating. The heated water in the reservoir 220 can be dispensed or pumped through an outlet (not shown) and directed through a series of hoses or pipes to a desired location.

Figure 12:
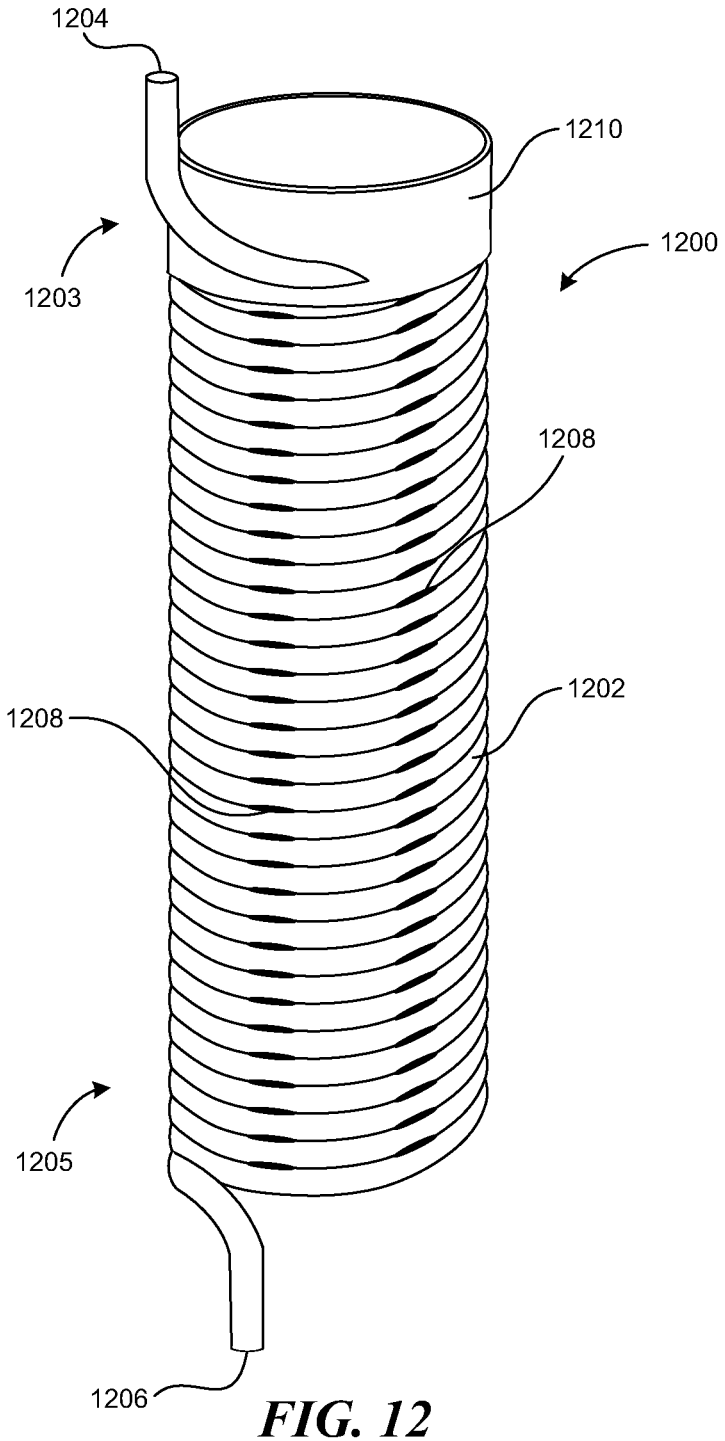
FIG. 12 is an isometric view of a heating coil configured in accordance with an embodiment of the present disclosure.

FIG. 12 is an isometric view of a flame director or heating coil 1200 configured in accordance with an embodiment of the present disclosure. The heating coil 1200 can direct flame and combustion gases through the shell of a water heater in a manner at least generally similar to that described above with respect to the flame tubes 308, as will be further described below. In the illustrated embodiment, the heating coil 1200 includes a metal or metal alloy tube 1202 that can be rolled, bent or otherwise formed into the coiled tubular or cylindrical shape illustrated in FIG. 12. Water can be flowed or directed into an inlet 1204 at an upper end 1203 of the heating coil 1200. For example, in one embodiment, in addition to directing water to the manifold 302, 402, 412 or 414, the water inlet 208 (FIGS. 2 and 3) can include one or more junctions or outlets that can provide water to one or more heating coils 1200. In some embodiments, the manifolds 302, 402, 412 or 414 can include one or more junctions or outlets positioned at other locations and configured to direct water to one or more heating coils 1200. In operation, water flows into the inlet 1204, through the heating coil 1200, and exits through an outlet 1206 at a lower end 1205 of the heating coil 1200. A shroud 1210 can be positioned (e.g., welded) at the upper end 1203 of the heating coil 1200. The shroud 1210 can aid in providing a uniform fit between the heating coil 1200 and an individual cone 310 (FIGS. 3-4C). In operation, flame and combustion gases directed through the heating coil 1200 can heat the metal tube 1202, causing expansion of the metal tube 1202. A plurality of individual weld joints or welds 1208 connecting adjoining portions of the metal tube 1202, however, can reduce expansion of the heating coil 1200 caused by the heating.

Figure 13:
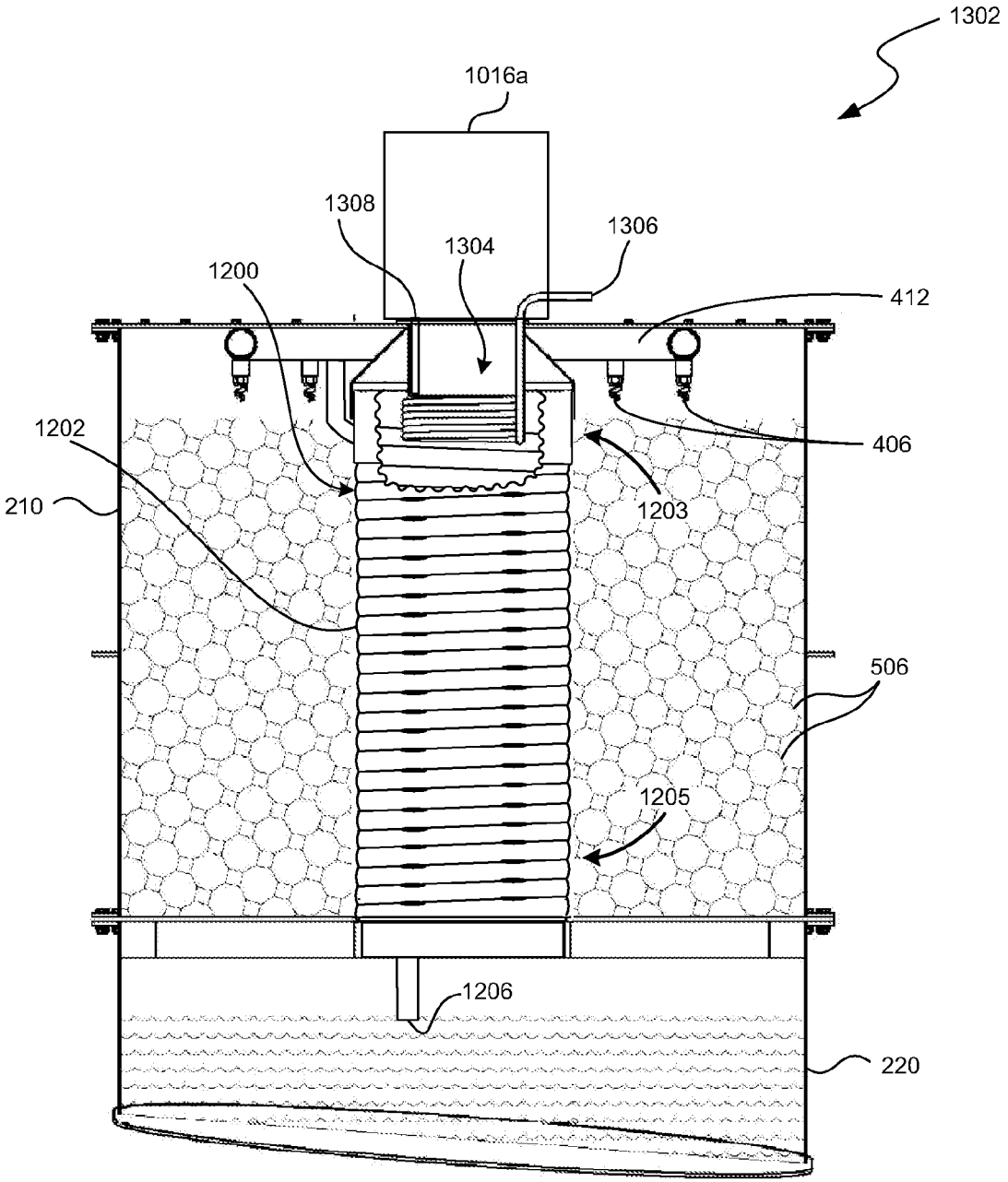
FIG. 13 is a partially schematic, partially cutaway, cross-sectional side view of a water heater configured in accordance with an embodiment of the present disclosure.

FIG. 13 is a partially schematic, partially cutaway, cross-sectional side view of a water heater 1302 configured in accordance with an embodiment of the present disclosure. In the illustrated embodiment, the water heater 1302 includes two heating coils 1200 (only one visible in FIG. 13). Vaporization coils 1304 (only one visible in FIG. 13), each having an inlet 1306 and an outlet 1308, can be positioned within the upper portion 1203 of each of the heating coils 1200 and operably coupled to provide propane to individual burners 1016*a*, 1016*b* (burner 1016*b* not visible in FIG. 13) via the outlets 1308.

The water heater 1302 can operate in a manner at least generally similar to the water heater 102 described above. For example, LPG can be directed to the inlets 1306 of the vaporization coils 1304. The LPG can be converted to gaseous propane within the vaporization coils 1304 and directed through the outlets 1308 to the burners 1016. The burners 1016 can burn the gaseous propane and direct the flame and resulting combustion gases downwardly through the heating coils 1200. Water can be directed to the manifold 412 and through the tubes 1202 of the heating coils 1200, as described above. The flame and the combustion gases can heat the heating coils 1200, resulting in heating of the water traveling through the heating coils 1200. The heated water can exit the heating coils 1200 through the outlets 1206 and be directed into the water reservoir 220. The water traveling through the heating coils 1200 can cool the heating coils 1200. Additionally, water from the manifold 412 can be sprayed from the nozzles 406 and travel downwardly through the pall rings 506. The nozzles 406 can be positioned to direct the water uniformly, or at least approximately uniformly, over the top of the pall rings 506. In the illustrated embodiment, the nozzles 406 are positioned to direct a spray pattern of water onto the pall rings 506 without spraying water directly onto the heating coils 1200. In other embodiments, the nozzles 406 can be positioned to spray water onto the pall rings 506 and the heating coils 1200, or just onto the heating coils 1200. The combustion gases and heated air can exit the lower end 1205 of the heating coils 1200 and travel upwardly, heating the water traveling downwardly through the pall rings 506. Accordingly, the water in the reservoir 220 can include water that has been heated as it travels through the tubes 1202 of the heating coils 1200, as well as water that has been heated as it travels downwardly through the pall rings 506. Furthermore, the flame and the combustion gases can be directed downwardly through the heating coils 1200 into the water reservoir 220, further heating the water in the water reservoir 220. Although the term "heating coil" is used herein to refer to the heating coils 1200, flame directors in accordance with the present technology, including the heating coils 1200, can also be referred to as flame tubes.

Figure 14:
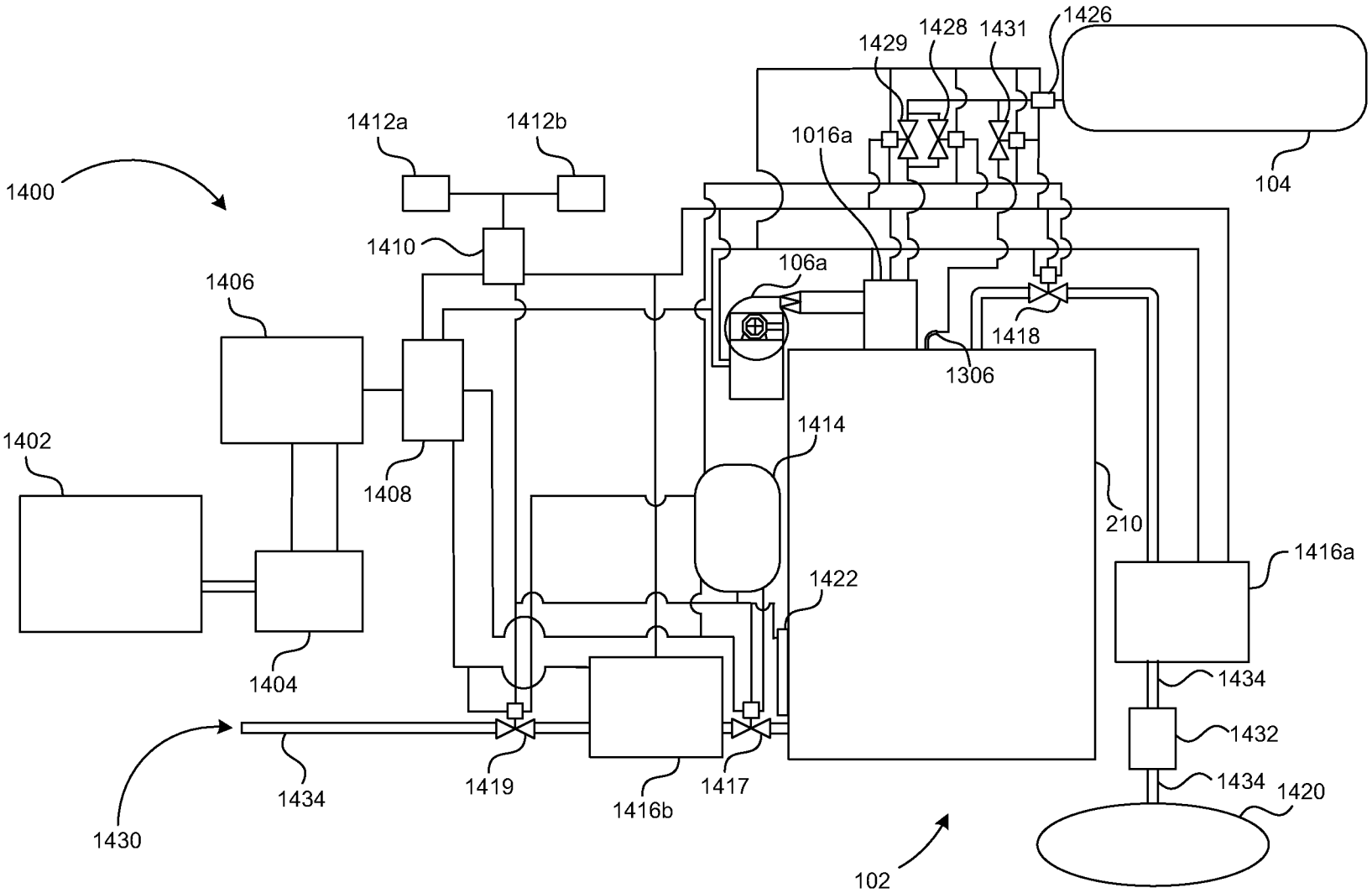
FIG. 14 is a schematic diagram of a water heating system configured in accordance with an embodiment of the present disclosure.

A variety of control systems, computers, electrical devices, mechanical devices, electromechanical devices, and other suitable components can be employed in embodiments in accordance with the present technology. In several embodiments combinations of engines, generators, pumps, motors, valves, solenoids, sensors, electronic control circuits, controllers, converters, drivers, logic circuitry, control panels, displays, input/output (I/O) interfaces, connectors or ports, personal computers (PCs), computer readable media, software, and/or other components are operably connected to the water heater 102 to control or engage in various operations. For example, FIG. 14 is a schematic diagram of a water heating system 1400 having various components configured to control the water heater 102 in accordance with an embodiment of the present technology. In the illustrated embodiment, an engine 1402 is operably coupled to a hydraulic pump 1404. In one embodiment, the engine 1402 can be a main engine, e.g., an internal combustion engine, of the truck 107 (FIG. 1). The hydraulic pump 1404 can be operably coupled to a hydraulically driven generator 1406 to produce electrical power. The generator 1406 can be electrically coupled to a power distribution system 1408 that can distribute the electrical power to various components that operate or control the water heater 102.

A controller, e.g., a programmable logic controller 1410, can be coupled to a variety of components to control the operations of the water heater 102. For example, in the illustrated embodiment, the controller 1410 receives power from the distribution system 1408 and is electrically coupled to: the blowers 106 (second blower 106*b* not visible); the burners 1016 (second burner 1016*b* not visible); an inlet pump or first pump 1416*a* and an outlet pump or second pump 1416*b* (collectively, the pumps 1416); a pneumatic water inlet valve 1418; a pneumatic water outlet valve 1417; a pneumatic trim valve 1419; a water level sensor 1422; pneumatic pilot valves 1428 (only one visible in FIG. 14); pneumatic mid-burn valves 1429 (only one visible in FIG. 14); pneumatic full-burn valves 1431 (only one visible in FIG. 14); a fuel pump 1426; an air system 1414; and a first control panel 1412*a* and a second control panel 1412*b* (collectively, the control panels 1412). The controller 1410 and/or other components of the water heating system 1400 can include ports that can connect the controller 1410 to additional components, such as a host computer or PC to install or update software or can allow connections for operations such as field service or debugging. The controller 1410 can include memory, e.g., random access memory (RAM), read-only memory, and/or non-volatile random access memory (NVRAM). The memory can store software and data that can be executed or utilized by the controller to control various operations of the water heating system 1400.

The power distribution system 1408 can provide power to components of the water heating system 1400, including components that are electrically coupled to the controller 1410, as illustrated in FIG. 14. The air system 1414 can include an air compressor and an air tank to provide air to operate the pneumatic valves 1417-1419, 1428, 1429 and 1431 and/or to provide air for blowing down hoses, pipes and/or other components of the water heating system 1400. Embodiments in accordance with the present technology can include components positioned in a variety of suitable locations. For example, in one embodiment, the first control panel 1412*a* can be located in a cab of the truck 107 (FIG. 1) and the second control panel 1412*b* can be located proximate to the fuel tank 104. The control panels 1412 can include various user input devices for operation of the water heater 102 in a manual mode, in an automatic mode, and/or in other modes of operation (e.g., test modes). The controller 1410 and several of the components of the embodiment shown in FIG. 14 are schematically illustrated as being physically isolated from other components. However, it is to be understood that the controller 1410 and other components of the water heating system 1400 can be coupled to, integral with, or otherwise associated with a variety of other components or parts of the water heating system 1400 and/or of any ground vehicle to which the water heating system 1400 is operably coupled. For example, in one embodiment, the water heating system 1400 can include additional controllers 1400 that are integral with the burners 1016.

In operation, an operator can control the water heater 102 via either of the control panels 1412. The control panels 1412 can graphically display the condition of various components and/or of various operating parameters, e.g., pump status (on or off), valve status (open, closed, or trim position), burner status (off, pilot, mid-burn, or full-burn), inlet water temperature, outlet water temperature, temperature difference (e.g., outlet temperature minus inlet temperature), and flow rate (barrels of water per minute). The operator can start the engine 1402 and engage the hydraulic pump 1404 to provide power to the power distribution system 1408 and the air system 1414. The inlet pump 1416*a* can be coupled to a water source 1420 via hoses 1434 and a filter 1432. The filter 1432 can remove debris and/or contamination from the water to improve the efficiency and operation of the water heater 102. In one embodiment, the operator can open the inlet valve 1418 and start the inlet pump 1416*a* in the manual mode of operation. The inlet pump 1416*a* pumps water into the water heater 102 and the control panel indicates a rising water level via signals from the water level sensor 1422. When the water level reaches a predetermined level, the operator can put the system into automatic water level control and the controller 1410 can maintain the water level within a suitable range. For example, in automatic mode, the controller 1410 can open the outlet valve 1417, start the outlet pump 1416*b* and adjust the position of the trim valve 1419 to direct water out the discharge outlet 1430. When the water level drops below a predetermined lower limit, the controller 1410 can position the trim valve 1419 to restrict the flow, and when the water level rises above a predetermined upper limit, the controller 1410 can position the trim valve 1419 in a fully open position to increase the outflow.

A variety of suitable parameters can be used to initiate automatic shutdowns and/or other functions to provide safe operation or other control features. For example, in one embodiment, the level sensor 1422 can provide a signal to temporarily shut down the water heater 102 in the event the water level rises above a predetermined limit, or falls below a predetermined limit. In some embodiments, the burners 1016 and/or the controller 1410 can include computer readable instructions that instruct a delayed opening of the fuel valves and/or delays of other ignition sequence events until a predetermined amount of time has passed. For example, in one embodiment, the burners 1016 delay ignition until the blowers 106 have operated for at least 30 seconds to purge any combustible gases within the shell 210. The blowers 106 can provide various amounts of airflow during the purging of the shell 210. In one embodiment, the blowers 210 provide 3400 cubic feet per minute of airflow during purging.

An ignition sequence for the water heating system 1400 can include opening of the pilot valves 1428 and operation of igniters within the burners 1016. The burners 1016 can include sensors to determine if an ignition was successful, and if so, a signal can be sent to open the mid-burn valves 1429. Fuel flow through the mid-burn valves 1429 can produce sufficient flames to heat the vaporization coils 1304 (FIG. 12), and in many instances provides sufficient heat to maintain or achieve a desired output water temperature. After a predetermined time of operation with the mid-burn valves 1429 open, the full-burn valves 1431 can be opened to provide fuel to the vaporization coils via the vaporization coil inlets 1306 (only one visible in FIG. 14). The fuel pump 1426 can provide increased fuel flow to the burners 1016. For example, during operation in cold temperatures, fuel flow from the fuel tank 104 may be inadequate to provide sufficient liquid fuel to the vaporization coils 1304. The fuel pump 1426 can be activated via the controller 1410 to pump additional liquid fuel. In some embodiments, activation of the fuel pump 1426 is controlled manually via the control panels 1412.

The water heater 102 and the associated components illustrated in the Figures are illustrative of several embodiments of the present technology. In other embodiments, additional and/or fewer components can be included in a variety of suitable configurations. Additionally, in order to not obscure the present technology, well-known components are omitted and/or not set forth in detail in the Figures. For example, several embodiments can include regulators, pressure sensors, flow meters, switches, additional fuel valves, and/or other components.

Without being bound by any particular theory, it is believed that the multiple flame tubes 308, multiple heating coils 1200, multiple burners 512 and/or the oval-cylindrical shape of the water heaters 102, 1302 provide for a more efficient heating of the water. These features, alone or in combination with other features, can provide large volume hot water production in a mobile design of a size that permits transport on most roads. Accordingly, hot water heaters configured in accordance with the embodiments of the present disclosure can provide large volume mobile hot water production that can be used in a variety of suitable applications. Additionally, the heating coils 1200 described above can provide for lower noise generation when compared to heating systems of other designs. Again, without being bound by theory, it is believed that the shape of the heating coils 1200 can reduce noise production by providing multiple surfaces of varying angles for sound to reflect from. For example, the coiled tubular shape of the heating coil 1200 includes multiple coils of the metal tube 1202, each of which provides surfaces that can reflect the sound generated by the burners 1016.

Furthermore, existing heating solutions typically provide water temperature increases of 50-60 degrees Fahrenheit and water flow of approximately 250 gallons per minute. Several embodiments in accordance with the present technology can produce water temperature increases of from about 75 degrees to about 85 degrees Fahrenheit, with flow rates of about 450 gallons per minute. For example, in one embodiment, the water heater 102 can heat water from an inlet temperature of 40 degrees Fahrenheit to an outlet temperature of 125 degrees Fahrenheit with a flow rate of 450 gallons per minute. In other embodiments, higher or lower flow rates or ranges of temperature increases can be achieved, depending on the design characteristics of the particular embodiment. Additionally, existing water heating solutions often employ open heating chambers that utilize closed flow-through pipes to heat water. The open heat chambers can produce large amounts of heat and present a significant fire hazard. Embodiments in accordance with the present technology can heat water within an internal volume of a shell that is bathed in water. This can reduce the risk of fires and provide significant advantages in locations that may present fire dangers (e.g., oil and gas exploration or drilling sites).

From the foregoing, it will be appreciated that specific embodiments of the invention have been described herein for purposes of illustration, but that various modifications may be made without deviating from the spirit and scope of the various embodiments of the invention. For example, the water heaters disclosed herein can be constructed in various shapes and sizes, and can include differing numbers of flame tubes, heating coils and burners. Additionally, any of the embodiments shown or described herein may be combined with each other as the context permits. Accordingly, the invention is not limited except as by the appended claims.

We claim:

1. A water heating system comprising:

a water heater, the water heater comprising a shell defining an internal volume and having an oval shape;

a manifold having a plurality of nozzles positioned to spray a first portion of water within the internal volume;

a first heating coil positioned at least partially within the internal volume and having a first tube coiled in the shape of a first cylinder, wherein the first tube includes a first water inlet and a first water outlet, and wherein the first water inlet is positioned to receive a second portion of water that flows through the first tube to the first water outlet;

a second heating coil positioned at least partially within the internal volume and having a second tube coiled in the shape of a second cylinder, wherein the first heating coil and the second heating coil extend generally parallel and side by side in relation to one another, wherein the second tube includes a second water inlet and a second water outlet, wherein the second water inlet is positioned to receive a third portion of water that flows through the second tube to the second water outlet, and wherein the plurality of nozzles are positioned to spray the first portion of water external to the first heating coil and external to the second heating coil;

a first burner positioned to direct flames into the first cylinder to heat the second portion of water via contact of the flames with the first heating coil;

a second burner positioned to direct flames into the second cylinder to heat the third portion of water via contact of the flames with the second heating coil;

a first vaporization coil having a first fuel inlet for receiving a first portion of fuel and a first fuel outlet for providing the first portion of fuel to the first burner, wherein the first vaporization coil is positioned to receive heat via the flames from the first burner and transform at least a portion of the first portion of fuel from a liquid state to a gaseous state; and a second vaporization coil having a second fuel inlet for receiving a second portion of fuel and a second fuel outlet for providing the second portion of fuel to the second burner, wherein the second vaporization coil is positioned to receive heat via the flames from the second burner and transform at least a portion of the second portion of fuel from a liquid state to a gaseous state.

2. The water heating system of claim 1 wherein a largest dimension of the shell is less than 4.1 meters, and wherein the water heating system further comprises:

a fuel tank positioned to deliver fuel to the first burner and to the second burner; and a ground vehicle carrying the fuel tank and the water heater.

3. The water heating system of claim 1 wherein the manifold includes a junction configured to transfer water to the first water inlet and the second water inlet.

4. The water heating system of claim 1 wherein the first heating coil and the second heating coil further include a plurality of welds joining corresponding adjacent tube portions of the first heating coil together and joining corresponding adjacent tube portions of the second heating coil together to reduce expansion of the first heating coil and the second heating coil.

5. A mobile water heater comprising:

a water reservoir positioned to receive and contain water;

a shell removably coupled to the water reservoir and having an internal volume and an oval shape;

a first heating coil positioned at least partially within the internal volume and comprising a first coiled tube formed into the shape of a first cylinder, the first coiled tube configured to direct a first portion of water to the water reservoir;

a second heating coil positioned at least partially within the internal volume, the second heating coil comprising a second coiled tube formed into the shape of a second cylinder, the second coiled tube configured to direct a second portion of water to the water reservoir, and wherein the first heating coil and the second heating coil extend generally parallel and side by side in relation to one another;

a manifold having a plurality of nozzles positioned to spray a third portion of water within the internal volume and external to the first heating coil and the second heating coil;

a first burner positioned to direct flames into the first cylinder to heat the first portion of water via contact of the flames with the first coiled tube;

a second burner positioned to direct flames into the second cylinder to heat the second portion of water via contact of the flames with the second coiled tube;

a first conduit that delivers fuel to the first burner;

a second conduit that delivers fuel to the second burner, wherein the first conduit and the second conduit are configured to transform liquid fuel into gaseous fuel via heat produced by the flames from the first burner and the second burner, respectively;

a ground vehicle; and a fuel tank, wherein at least the water reservoir and the fuel tank are carried by the ground vehicle.

6. The mobile water heater of claim 5, further comprising:

a lid having a plurality of exhaust vents, wherein the lid is removably coupled to the shell and the manifold is operably coupled to an underside of the lid; and a vent assembly operably coupled to the topside of the lid to receive exhaust from the shell, the vent assembly including:

a plurality of diffusers, wherein individual diffusers are positioned in individual exhaust vents to reduce moisture in the exhaust gases exiting the exhaust vents;

an enclosure removably coupled to the lid; and media positioned within the enclosure to gather moisture from the exhaust gases.

7. The mobile water heater of claim 5 wherein the first coiled tube comprises a plurality of adjacent tube portions, and wherein the adjacent tube portions are welded together via a plurality of corresponding weld joints.

* * * * *